United States Patent [19]

Hase et al.

[11] Patent Number: 4,559,158

[45] Date of Patent: Dec. 17, 1985

[54] ORGANIC CYANAMIDE COMPOUNDS AS ACTIVATORS FOR INORGANIC PER COMPOUNDS

[75] Inventors: Christian Hase, Erkrath; Edgar Koeppelmann, Hilden, both of Fed. Rep. of Germany

[73] Assignee: Henkel Kommanditgesellschaft auf Aktien, Duesseldorf, Fed. Rep. of Germany

[21] Appl. No.: 577,114

[22] Filed: Feb. 6, 1984

[30] Foreign Application Priority Data

Feb. 12, 1983 [DE] Fed. Rep. of Germany ..... 3304848

[51] Int. Cl.[4] ..... C11D 7/54

[52] U.S. Cl. ..... 252/102; 252/99; 252/106; 252/186.38

[58] Field of Search ..... 252/99, 102, 106, 186.38

[56] References Cited

U.S. PATENT DOCUMENTS

| | | | |
|---|---|---|---|
| 3,177,148 | 4/1965 | Bright et al. | 252/102 |
| 3,986,973 | 10/1976 | Loffelman et al. | 252/102 |
| 4,025,453 | 5/1977 | Kravetz et al. | 252/186.38 |
| 4,086,175 | 4/1978 | Kravetz et al. | 252/186.38 |
| 4,086,177 | 4/1978 | Kubitschek et al. | 252/102 |
| 4,199,466 | 4/1980 | Benson, Jr. | 252/186.38 |
| 4,392,975 | 7/1983 | Tourdot et al. | 252/102 |

FOREIGN PATENT DOCUMENTS

| | | |
|---|---|---|
| 1162967 | 8/1967 | Fed. Rep. of Germany . |
| 1257768 | 1/1968 | Fed. Rep. of Germany . |
| 1695219 | 4/1974 | Fed. Rep. of Germany . |
| 39752 | 10/1980 | France . |
| 93142 | 4/1981 | France . |

OTHER PUBLICATIONS

Chemical Reviews-vol. 35, (1944), p. 381.

Kirk-Othmer Encyclopedia of Chemical Technology 3rd Edition-vol. 7, pp. 291-293, 298.

*Primary Examiner*—A. Lionel Clingman

*Assistant Examiner*—Willie J. Thompson

*Attorney, Agent, or Firm*—Ernest G. Szoke; Henry E. Millson, Jr.; Mark A. Greenfield

[57] ABSTRACT

Cyanamide compounds corresponding to the following formula

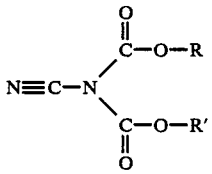

in which R and R′ each represent $C_1$–$C_6$-alkyl, cyclohexyl and benzyl, are used as activators for inorganic per compounds. They are preferably used in the mildly alkaline range at temperatures below 45° C. Applications include the bleaching of textiles and hard surfaces, the oxidation of organic and inorganic intermediate products, and disinfection.

38 Claims, No Drawings

ORGANIC CYANAMIDE COMPOUNDS AS ACTIVATORS FOR INORGANIC PER COMPOUNDS

BACKGROUND OF THE INVENTION

Inorganic per compounds, particularly hydrogen peroxide and solid per compounds which dissolve in water with release of hydrogen peroxide, such as sodium perborate and sodium carbonate perhydrate, have long been used as oxidizing agents for disinfection and bleaching purposes. The oxidizing effect of these compounds in dilute solutions is governed to a large extent by the temperature. Thus, with $H_2O$ 2 or perborate for example in alkaline bleaching liquors, sufficiently rapid bleaching of soiled textiles is only obtained at temperatures above about 80° C. At lower temperatures, the oxidizing effect of inorganic per compounds can be improved by the addition of so-called activators, for which numerous proposals have been made in the literature. Thus, the tetraacetyl glycol uril described in German Pat. No. 1,695,219 and, more recently, the tetraacetyl ethylene diamine described in German Pat. No. 1,162,967 are used in practice. By adding these compounds, the bleaching effect of aqueous peroxide liquors can be increased to such an extent that the effects obtained with the peroxide liquor alone at 95° C. are achieved at only 60° C.

In the endeavor to find energy-saving washing and bleaching processes, usage temperatures distinctly below 60° C. and, more particularly, below 45° C., including down to the temperature of cold water, have acquired increasing significance in recent years.

Unfortunately, known activators lose much of their effect at temperatures as low as these. Accordingly, there has been no shortage of attempts to develop more effective activators for this temperature range, but hitherto to no real avail.

DESCRIPTION OF THE INVENTION

The object of the present invention is to improve the oxidizing and bleaching effect of inorganic per compounds at low temperatures, more particulary, at temperatures in the range of from about 15° to about 45° C.

It has been found that, where certain organic cyanamide compounds are used as activators in the above temperature range, a marked increase is obtained in the oxidizing and bleaching effect of inorganic per compounds in oxidation, bleaching and wash liquors. These cyanamide activators are compounds corresponding to the following formula

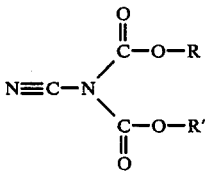

(I)

in which R and R′ can be the same or different and can each represent $C_1$–$C_6$-alkyl (straight or branched chain), cyclohexyl, or benzyl. These compounds are known compounds. They can be produced, for example by the process described in German Pat. No. 1,257,768. It is particularly preferred to use the dimethyl or dibenzyl compounds, which have a relatively high melting point.

The cyanamide compounds corresponding to formula I can be used as activators for any applications requiring a substantial increase in the oxidizing effect of inorganic per compounds at low temperatures, for example, in the bleaching of textiles, hair or hard surfaces; in the oxidation of organic or inorganic intermediate products; and in disinfection.

The inorganic per compounds that can be used herein are inorganic compounds containing a peroxy group. Prefered compounds are hydrogen peroxide and those compounds which release hydrogen peroxide in solution, such as perborates, percarbonates, perphosphates, and persilicates which are alkali metal salts, alkali metal peroxides, e.g. sodium peroxide, or addition compounds of hydrogen peroxide, e.g. with urea, sodium chloride, and sodium sulfate.

The use of the novel compositions of the invention is based on the creation of conditions under which hydrogen peroxide and the cyanamide compounds set forth above can react with one another to obtain reaction products having a stronger oxidizing effect. Conditions such as these are especially present when both reactants come into contact with each other in aqueous alkaline solution.

However, the conditions of reaction can be varied within wide limits, depending on the application. Thus, in addition to pure aqueous solutions, mixtures of water and organic solvents can be used as the reaction medium, for example, for use in disinfection or in the oxidation of intermediate products. The pH-value of the reaction medium can vary within wide limits from the mildly acidic range (about pH 4) to the strongly alkaline range (about pH 13), depending on the application. The alkaline range of from about pH 8 to about pH 11 is preferred because it is particularly advantageous for the activation reaction and for the stability of the per compound formed. For this reason, the activators of the invention preferably contain sodium perborate and/or sodium carbonate perhydrate which, in aqueous solution, already have pH-values in that range. The quantity of activator used also depends upon the application. Depending upon the required degree of activation, the activator is used in a quantity of from about 0.05 to about 1 mole, and preferably in a quantity of from about 0.2 to about 1 mole, per mole of inorganic per compound, although in special cases it can also be used in larger or smaller quantities.

For activation, the cyanamide derivatives of the invention can be used in pure form or, if appropriate, for example to increase shelf life, in specially made up forms, such as tablets, granulates or in finely particulate coated form (so-called prills). Liquid activators or solutions in inorganic solvents are suitable for machine metering.

The cyanamide derivatives of the invention are preferably used in admixture with the per compounds to be activated and, optionally, other components essential to the desired bleaching or oxidation process, such as pH regulators and stabilizers for the per compounds. Admixture with the per compounds and other additives facilitates use and enables the user to obtain the required result with greater certainty, although the method of use of the compositions of the invention is not confined to this particular form of application.

In the laundry field, the activators of the invention can be combined with virtually any of the standard ingredients of detergents and bleaches. It is possible in this way to make up preparations which are particularly suitable for the treatment of textiles at low temperatures and also preparations which can be used in several temperature ranges up to the traditional range of boil-washing.

In addition to per compounds and activators, principle constituents of detergents and bleaches such as these are builders and surfactants. In addition, other standard auxiliaries, such as redeposition inhibitors, peroxide stabilizers, electrolytes, optical brighteners, enzymes, perfume oils, foam regulators and conditioners, can be present in these preparations as appropriate.

Examples of standard builders are polymeric phosphates, salts of aminocarboxylic acids, such as nitrilotriacetic acid, salts of polyphosphonic acids, such as hydroxy ethane diphosphonic acid, salts of polycarboxylic acids, such as citric acid or polyacrylic acid, and insoluble sodium aluminium silicates of the zeolite NaA and NaX type.

Surfactants useful in such compositions are, in particular, those of the nonionic and synthetic anionic surfactant type. Examples of nonionic surfactants are the polyethylene glycol monoalkyl and polyethylene glycol monophenyl ethers obtained from long-chain alcohols or alkyl phenols and ethylene oxide.

The anionic surfactants are, primarily, sulfates and sulfonates of long-chain compounds, for example alkyl benzene sulfonates, fatty acid ester sulfonates, alkane sulfonates, olefin sulfonates, fatty alcohol sulfates and sulfates of polyethylene glycol monoethers.

In addition to combined detergents and bleaches, the activators according to the invention for washing textiles can also be made up in the form of preparations which are added to peroxide-containing or peroxide-free detergents. They essentially contain the activator or a mixture of activator and per compound and, optionally, other auxiliaries and additives, more particularly stabilizers, pH regulators and surfactants.

In addition to per compound and activator, preparations intended for cleaning hard surfaces contain, in particular, surfactants, builders and, in the case of polishes and scouring compositions, abrasive constituents. Since these preparations are frequently used at room temperature, the use of the activators according to the invention in this case has a particularly advantageous effect on the bleaching and germicidal effect.

Particular significance is attributed to ready-made preparations for use in disinfection because, in this case, more stringent demands are generally imposed upon safety in regard to practical application. Disinfectants based on the activators of the invention generally contain other auxiliaries and additives, such as pH regulators, stabilizers and surfactants, in addition to the activators and inorganic per compounds. In certain cases, they may additionally contain special microbicides which intensify the basically very broad germicidal effect of the activated per compound on certain microorganisms.

However, the use of the activators in accordance with the invention is by no means confined to their use in these or other made-up forms. Thus, the individual dosage of reagents is generally preferred in the industrial sector for example because it is often more favorable in terms of cost.

The invention will be illustrated but not limited by the following examples.

EXAMPLES

An analytical process for determining peroxide activation and, as an example of the intensified oxidation effect of the peroxides activated in accordance with the invention, practical tests for bleaching textiles in a washing process are set forth in the following examples.

EXAMPLE 1

Determination of peroxide activation

Known activators of the N-acetylamide type activate inorganic per compounds by acetylating the hydrogen peroxide released from the per compounds in solution to form peracetic acid:

$$-CO-\overset{|}{N}-COCH_3 + H_2O_2 \longrightarrow -CO-\overset{|}{N}H + CH_3CO_3H$$

The peracetic acid formed may be determined by iodometric titration, the hydrogen peroxide not being titrated under the specific conditions used.

A similar reaction is presumed for the activators used in accordance with the invention because they respond in the same iodometric test. This test, which is described hereinafter, provides indications as to how quickly reaction products having a stronger oxidizing effect are formed from $H_2O_2$ and the activators. However, a comparison of various activators using this test is only appropriate if the activators are used in quantities which are equivalent in regard to the reacting groups. In each case, 4 mMoles/1 of the activators according to the invention and 2 mMoles/1 of tetraacetyl ethylene diamine (TAED) were used for the tests.

Test Procedure:

2.5 g of $Na_2P_2O_7 10\ H_2O$ and 630 mg of sodium perborate tetrahydrate (4 mMoles/1) were dissolved in 1 liter of water. After tempering, the quantities of each activator were added all at once to the resulting solution. The solution was then stirred for 30 minutes After certain times, 100 ml samples were taken and pipetted onto 250 g of ice and 15 ml of glacial acetic acid, after which 5 ml of 10% KI-solution were added. This was immediately followed by titration with 0.1 N $Na_2S_2O_3$-solution until the color changes. Just before the end of titration, approximately 1 ml of a 1% starch solution was added. The proporation of perborate present in activated form at the particular time can be calculated from the result of the titration: 8 ml of 0.1 N $Na_2S_2O_3$ corresponding to 100%.

Table 1 below shows the results obtained in this test with activators according to the invention and the known activator, tetraacetyl ethylene diamine (TAED), at 30° C., expressed in % of activated perborate.

TABLE 1

$N\equiv C-N(CO_2R)(CO_2R')$ R = R'

| Time mins. | R = $CH_3$ | $C_2H_5$ | n-$C_4H_9$ | TAED |
|---|---|---|---|---|
| 1 | 88 | 77 | 21 | 29 |
| 5 | 90 | 90 | 58 | 63 |
| 10 | 87 | 90 | 76 | 77 |
| 15 | 85 | 88 | 86 | 81 |
| 30 | 76 | 82 | 85 | 84 |

The results show that the activators according to the invention gave a reaction product capable of oxidation as quickly as or more quickly than TAED.

EXAMPLE 2

Determination of the Bleaching Effect

In order to ascertain the effects of the activators under quasi-practical bleaching conditions, artificially soiled cotton cloths are washed with a perborate-containing detergent and various activators in a Launderometer of the Atlas Standard Type. The test conditions were as follows:

| | |
|---|---|
| Liquor volume: | 250 ml |
| Fabric: | 6.3 g of white filling cotton<br>2.1 g of bleaching test fabric |
| Water hardness: | 17° d.H. (d.H. deutsche Harte = German hardness) |
| Temperature: | 20 and 40° C. |
| Washing time: | 30 minutes, including heating-up time (3° C./minute) |
| Rinsing: | 3 × 30 seconds |

Detergent Composition:

7% of alkyl benzene sulfonate, 2% of tallow alcohol +5 EO, 2% of tallow soap, 25% of $Na_5P_3O_{10}$, 17% of zeolite NaA (SASIL®), 3.5% of waterglass ($Na_2O \times 3.3\ SiO_2$), 0.15% of EDTA, remainder: $Na_2SO_4$ Dosage: 6 g/l of detergent, 1 g/l of perborate tetrahydrate (=100 ppm of active oxygen), activator.

The results were evaluated by remission measurements on the dried fabrics. The results set out in Tables 2 and 3 below represent the remission values measured at a wavelength of 460 nm. Higher values indicate lighter fabric.

TABLE 2

Bleaching results at 20° C. on test fabrics with different stains

| Activator | Dosage mMole/l | Stain: red-currant | red wine | coffee | tea |
|---|---|---|---|---|---|
| Without perborate or activator | — | 57.8 | 52.5 | 61.0 | 58.6 |
| With perborate, without activator | — | 58.6 | 53.5 | 64.5 | 60.2 |
| With perborate plus: | | | | | |
| Bismethoxycarbonyl-cyanamide | 2 | 63.8 | 60.8 | 67.2 | 65.2 |
| Bisethoxycarbonyl-cyanamide | 2 | 65.6 | 61.2 | 67.8 | 65.0 |
| Bisbutoxycarbonyl-cyanamide | 2 | 64.5 | 63.3 | 68.6 | 64.8 |
| Bisbenzyloxycarbonyl-cyanamide | 2 | 61.4 | 56.0 | 66.6 | 62.3 |
| With perborate plus: TAED | 1 | 60.9 | 56.6 | 66.3 | 62.8 |

TABLE 3

Bleaching results at 40° C. on test fabrics with different stains

| Activator | Dosage mMole/l | Stain: red-currant | red wine | coffee | tea |
|---|---|---|---|---|---|
| Without perborate or activator | — | 62.0 | 54.9 | 65.7 | 62.0 |
| With perborate, without activator | — | 62.4 | 56.6 | 70.9 | 65.6 |
| With perborate plus: | | | | | |
| Bismethoxycarbonyl cyanamide | 2 | 71.7 | 65.5 | 74.9 | 72.7 |
| Bisethoxycarbonyl cyanamide | 2 | 72.5 | 65.1 | 74.6 | 73.0 |
| Bisbutoxycarbonyl cyanamide | 2 | 70.8 | 64.5 | 73.4 | 72.3 |
| Bisbenzyloxycarbonyl cyanamide | 2 | 72.6 | 67.5 | 76.3 | 73.2 |
| With perborate plus: TAED | 1 | 70.2 | 63.2 | 72.7 | 70.4 |

The remission values show that a stronger bleaching effect was obtained with the activators according to the invention both at 20° C. and 40° C. than with conventional activators, such as TAED.

Similar increases in the oxidation effect of inorganic per compounds are also obtained in other fields of application.

What is claimed is:

1. A composition comprising a. at least one inorganic peroxy-group containing compound; and b. an activating quantity of at least one cyanamide compound of the formula

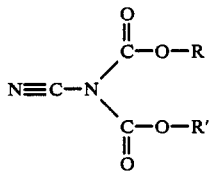

(I)

wherein R and R′ can be the same or different and are each $C_1$–$C_6$ alkyl, cyclohexyl, or benzyl.

2. A composition in accordance with claim 1 wherein from about 0.05 to about 1 mole of component b. is present per mole of component a.

3. A composition in accordance with claim 1 wherein from about 0.2 to about 1 mole of component b. is present per mole of component a.

4. A composition in accordance with claim 1 wherein in a. the inorganic peroxy-group containing compound is at least one of the following: hydrogen peroxide, and compounds which release hydrogen peroxide in solution.

5. A composition in accordance with claim 4 wherein the inorganic peroxy-group containing compound is sodium perborate or sodium carbonate perhydrate.

6. A composition in accordance with claim 1 wherein in component b. R and R′ are both methyl.

7. A composition in accordance with claim 1 wherein in component b. R and R′ are both benzyl.

8. A bleach composition comprising a. an effective quantity of at least one inorganic peroxy-containing compound;

b. an activating quantity of at least one cyanamide compound of the formula

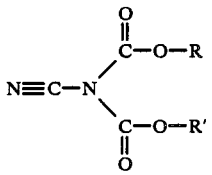

(I)

wherein R and R′ can be the same or different and are each $C_1$–$C_6$ alkyl, cyclohexyl, or benzyl; and c. bleach auxiliary materials.

9. A bleach composition in accordance with claim 8 wherein from about 0.05 to about 1 mole of component b. is present per mole of component a.

10. A bleach composition in accordance with claim 8 wherein from about 0.2 to about 1 mole of component b. is present per mole of component a.

11. A bleach composition in accordance with claim 8 wherein in a. the inorganic peroxy-group containing compound is at least one of the following: hydrogen peroxide, and compounds which release hydrogen peroxide in solution.

12. A bleach composition in accordance with claim 11 wherein the inorganic peroxy-group containing compound is sodium perborate or sodium carbonate perhydrate.

13. A bleach composition in accordance with claim 8 wherein in component b. R and R′ are both methyl.

14. A bleach composition in accordance with claim 8 wherein in component b. R and R′ are both benzyl.

15. A disinfectant composition comprising a. an effective quantity of at least one inorganic peroxy-containing compound;

b. an activating quantity of at least one cyanamide compound of the formula

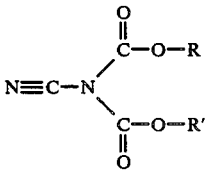

(I)

wherein R and R′ can the same or different and are each $C_1$–$C_6$ alkyl, cyclohexyl, or benzyl; and c. disinfectant auxiliary materials.

16. A disinfectant composition in accordance with claim 15 wherein from about 0.05 to about 1 mole of component b. is present per mole of component a.

17. A disinfectant composition in accordance with claim 15 wherein from about 0.2 to about 1 mole of component b. is present per mole of component a.

18. A disinfectant composition in accordance with claim 15 wherein in a. the inorganic peroxy-group containing compound is at least one of the following: hydrogen peroxide, and compounds which release hydrogen peroxide in solution.

19. A disinfectant composition in accordance with claim 15 wherein the inorganic peroxy-group containing compound is sodium perborate or sodium carbonate perhydrate.

20. A disinfectant composition in accordance with claim 15 wherein in component b. R and R′ are both methyl.

21. A disinfectant composition in accordance with claim 15 wherein in component b. R and R′ are both benzyl.

22. A process for the low temperature activation of an inorganic peroxy-group containing compound comprising contacting said compound with an activating quantity of at least one cyanamide compound of the formula

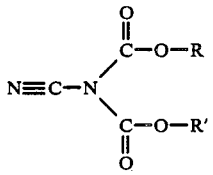

(I)

wherein R and R′ can be the same or different and are each $C_1$–$C_6$ alkyl, cyclohexyl, or benzyl.

23. A process in accordance with claim 22 wherein from about 0.05 to about 1 mole of the cyanamide compound of formula I is present per mole of peroxy-group containing compound.

24. A process in accordance with claim 22 wherein the activation is carried out in predominantly aqueous solution.

25. A process in accordance with claim 24 wherein the pH of the aqueous solution is in the range of from about 4 to about 13.

26. A process in accordance with claim 24 wherein the pH of the aqueous solution is in the range of from about 8 to about 11.

27. A process in accordance with claim 22 wherein from about 0.2 to about 1 mole of the cyanamide compound of formula I is added per mole of peroxy-group containing compound.

28. A process in accordance with claim 22 wherein the inorganic peroxy-group containing compound is at least one of the following: hydrogen peroxide, and compounds which release hydrogen peroxide in solution.

29. A process in accordance with claim 28 wherein the inorganic peroxy-group containing compound is sodium perborate or sodium carbonate perhydrate.

30. A process in accordance with claim 22 wherein in the cyanamide compound of formula I R and R′ are both methyl.

31. A process in accordance with claim 22 wherein in the cyanamide compound of formula I R and R′ are both benzyl.

32. A detergent composition comprising a. an effective quantity of at least one inorganic peroxy-containing compound;

b. an activating quantity of at least one cyanamide compound of the formula

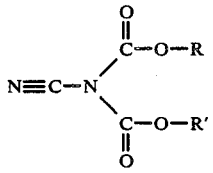

wherein R and R′ can be the same or different and are each $C_1$–$C_6$ alkyl, cyclohexyl, or benzyl; and c. detergent auxiliary materials.

33. A detergent composition in accordance with claim 32 wherein from about 0.05 to about 1 mole of component b. is present per mole of component a.

34. A detergent composition in accordance with claim 32 wherein from about 0.2 to about 1 mole of component b. is present per mole of component a.

35. A detergent composition in accordance with claim 32 wherein in a. the inorganic peroxy-group containing compound is at least one of the following: hydrogen peroxide, and compounds which release hydrogen peroxide in solution.

36. A detergent composition in accordance with claim 35 wherein the inorganic peroxy-group containing compound is sodium perborate or sodium carbonate perhydrate.

37. A detergent composition in accordance with claim 32 wherein in component b. R and R′ are both methyl.

38. A detergent composition in accordance with claim 32 wherein in component b. R and R′ are both benzyl.

* * * * *